United States Patent [19]

Almeland et al.

[11] 4,343,562

[45] Aug. 10, 1982

[54] JOINT FOR TRUSSES

[75] Inventors: Inge-Bertin Almeland; Marc Lefranc, both of Oslo, Norway

[73] Assignee: A/S Akers Mek. Verksted, Oslo, Norway

[21] Appl. No.: 105,268

[22] Filed: Dec. 19, 1979

[30] Foreign Application Priority Data

Dec. 22, 1978 [NO] Norway ..... 784353
Dec. 3, 1979 [NO] Norway ..... 793921

[51] Int. Cl.[3] ..... F16B 7/00

[52] U.S. Cl. ..... 403/171; 403/176; 52/81

[58] Field of Search ..... 403/173, 172, 171, 176, 403/170, 174, 178, 271, 217, 219; 52/80, 81, 648

[56] References Cited

U.S. PATENT DOCUMENTS 3,152,819 10/1964 Fentiman ..... 403/172
3,596,950 8/1971 Wipkink et al. ..... 403/172
4,092,077 5/1978 George ..... 403/178
4,101,230 7/1978 Moe ..... 403/171

FOREIGN PATENT DOCUMENTS 2444612 4/1976 Fed. Rep. of Germany ..... 403/219
301416 1/1972 U.S.S.R. ..... 403/172
497390 3/1976 U.S.S.R. ..... 403/176

*Primary Examiner*—Andrew V. Kundrat
*Attorney, Agent, or Firm*—Watson, Cole, Grindle & Watson

[57] ABSTRACT

The present invention relates to a joint for trusses having members comprising tube-like hollow bodies, comprising a core member to which is welded a plurality of transition pieces to which free end a tubular member can be welded, the cross section of the transition pieces changing between the free end of these and the end which is welded to the core member.

11 Claims, 14 Drawing Figures

JOINT FOR TRUSSES

A joint of this type is known inter alia from U.S. Pat. No. 3,596,950. Here the core member is constituted by a polyhedron body which is welded together from plate elements. The transition pieces between the truss members and the core member are welded to the plate elements of the core member, and the forces occuring in the truss members will thus load the plate elements generally transversely of the rolling direction of the plate material. Such transverse loading is undesirable since it easily may lead to laminar tearing of the plate material. In order to give the known core member sufficient strength, it is thus necessary to use excessive material. Since the circumference of the known transition pieces increase from their free end in the direction of the core member, the core member must have large dimensions, thus further increasing its weight.

If the known joint were to be used in the supporting structure for an offshore oil platform, for instance of the type described in U.S. Ser. No. 92,962, now abandoned, the bulky form of the joint would result in substantial wave forces which must be absorbed by the supporting structure. Due to the large truss member dimensions in question, such a joint would become so heavy that it would be difficult to handle as a unit during construction of the supporting structure.

A known joint of the aforementioned type is also shown in U.S. Pat. No. 4,101,230. Here the transition pieces are constituted by generally conical elements the narrow end of which is welded to an armlike protrusion on a solid core member. Due to the small moment of inertia of the cross section of these arms relative to the cross section of the truss members, the joint becomes so flexible that it would not transmit bending moments to any extent and thus act approximately like an ideal joint. This may be advantageous in certain uses, but it has been found that for large supporting structures in marine environments, especially for supporting structures of the type described in said Ser. No. 92,962, such flexibility in the joints could lead to considerable disadvantages. The truss members in such structures will therefore be subjected to quite high, periodically waving forces from waves, current and wind. These forces could easily induce vibrations in the members, and due to the relatively flexible support of the members at their ends, such vibrations could become so strong that danger of fatigue would occur. This requires the members to be made coarser than necessary from static calculations. Furthermore, the flexibility of the joints results in decreased buckling resistance of the truss members, necessitating coarser dimensions, higher weight and higher costs.

The purpose of the invention is to provide a joint of the type mentioned by way of introduction which does not have the above mentioned drawbacks and deficiencies. According to the invention the core member has an elongate, substantially cylindrical trunk which is provided with a plurality of longitudinal ribs, the cross section of at least some of the transition pieces changing from generally annular form as known per se at said free end to a narrower elongate form at the opposite end, the latter end having form of an elongate surface which is welded to one of said longitudinal ribs, at least two such transition pieces being welded to each of at least some of the ribs.

By this type of construction a compact joint is obtained having good material economy and low wave resistance. Furthermore, the joint will have high rigidity contributing to prevent vibrations in the truss members and concurrently increasing their buckling resistance.

Further advantageous features of the invention will appear from the following description of the exemplifying embodiments shown in the drawings.

Figure 3:
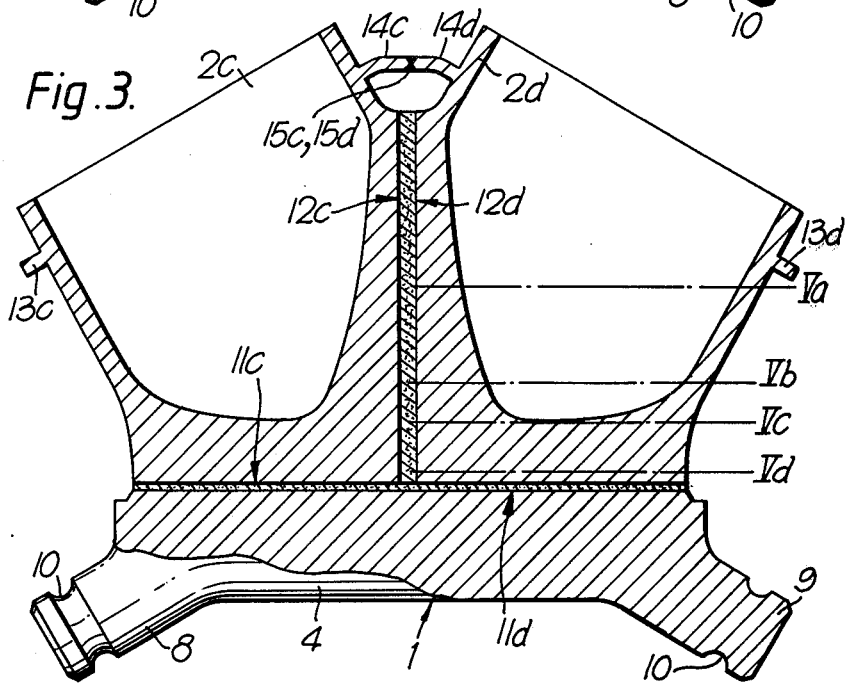
FIG. 3 shows a cross section generally along the line III—III in FIG. 1.

FIGS. 5*a*–5*d* shows sections along the lines V*a*–V*d*, respectively, in FIG. 3.

Figure 1:
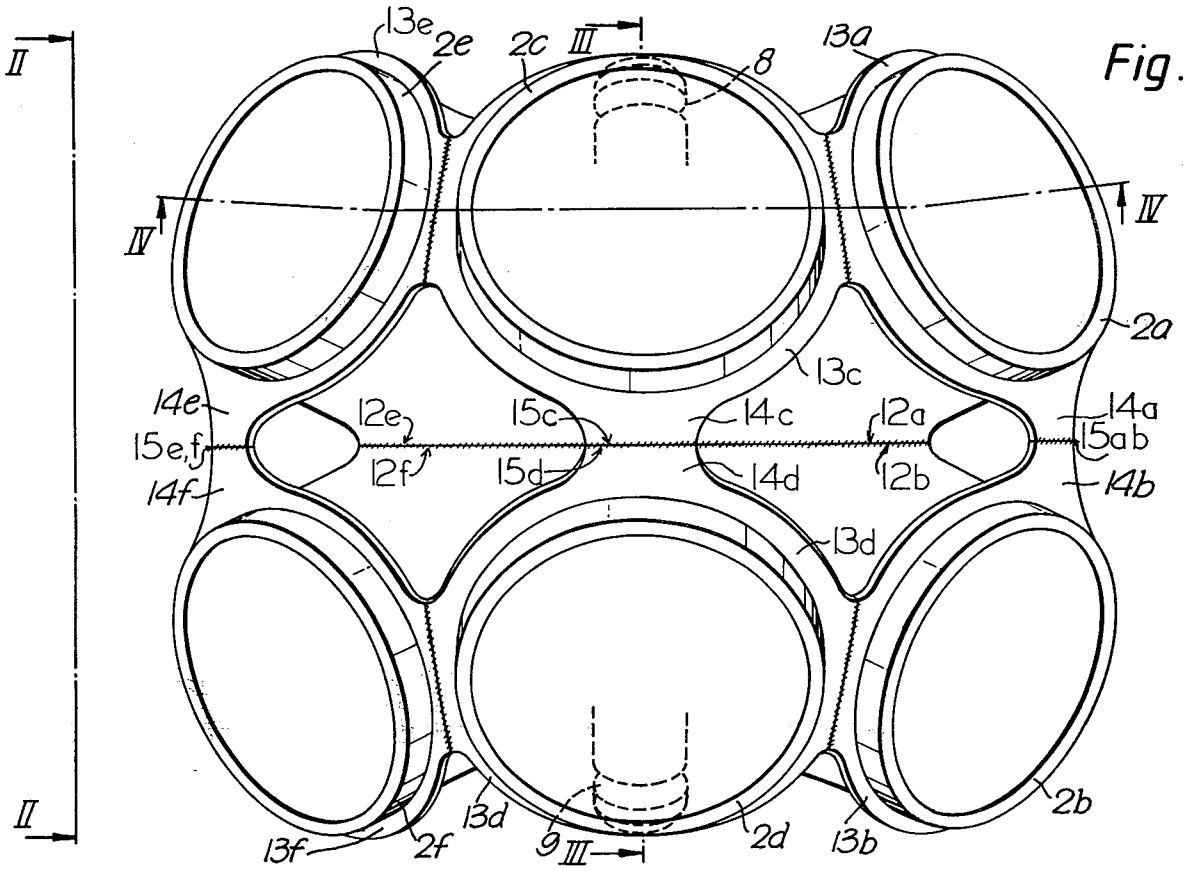
FIG. 1 shows a plan view of a joint according to the invention.
Figure 6:
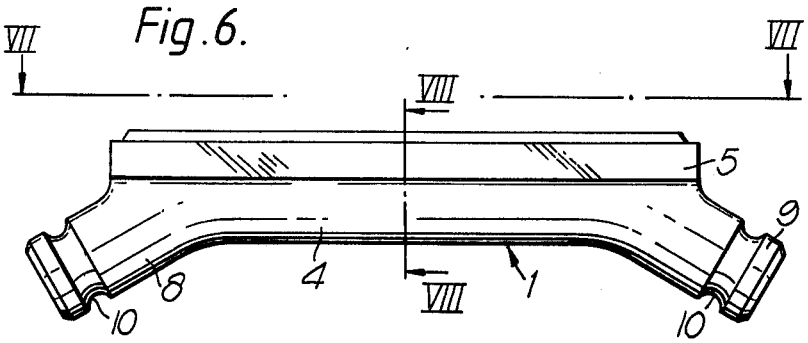

FIG. 6 shows a side view of the core member of the joint in FIG. 1.

Figure 7:
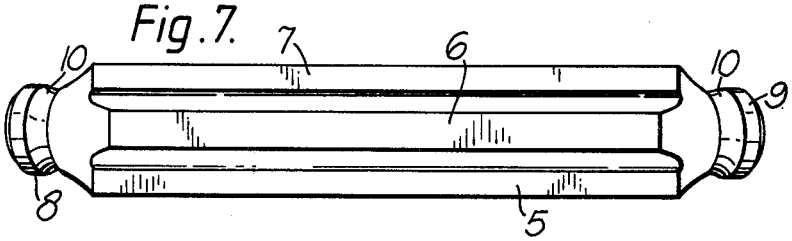

FIG. 7 shows the core member in FIG. 6 seen in the direction VII—VII.

Figure 8:
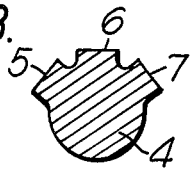

FIG. 8 shows a section along the line VIII—VIII in FIG. 6.

Figure 9:
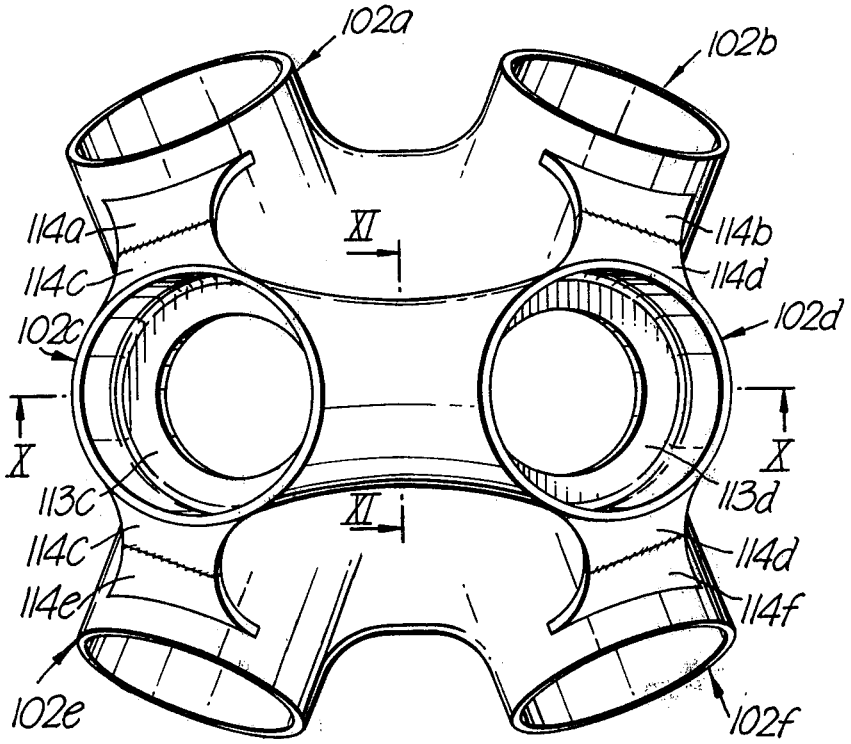

FIG. 9 shows a plan view of a second embodiment of the invention.

Figure 10:
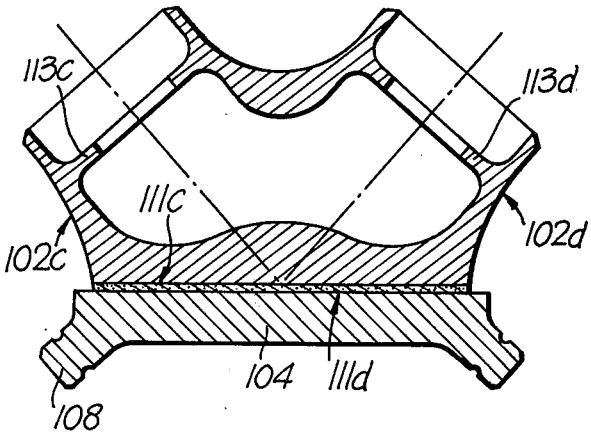

FIG. 10 shows a section along the line X—X in FIG. 9.

Figure 11:
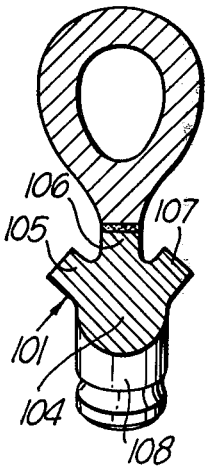

FIG. 11 shows a section along the line XI—XI in FIG. 9.

The illustrated joint is particularly suitable for the type of truss structure which is described in the aforementioned U.S. Ser. No. 92,962. In such structures six truss members meet in most of the joints, the joints being similar and even identical, making series production desirable.

Figure 2:
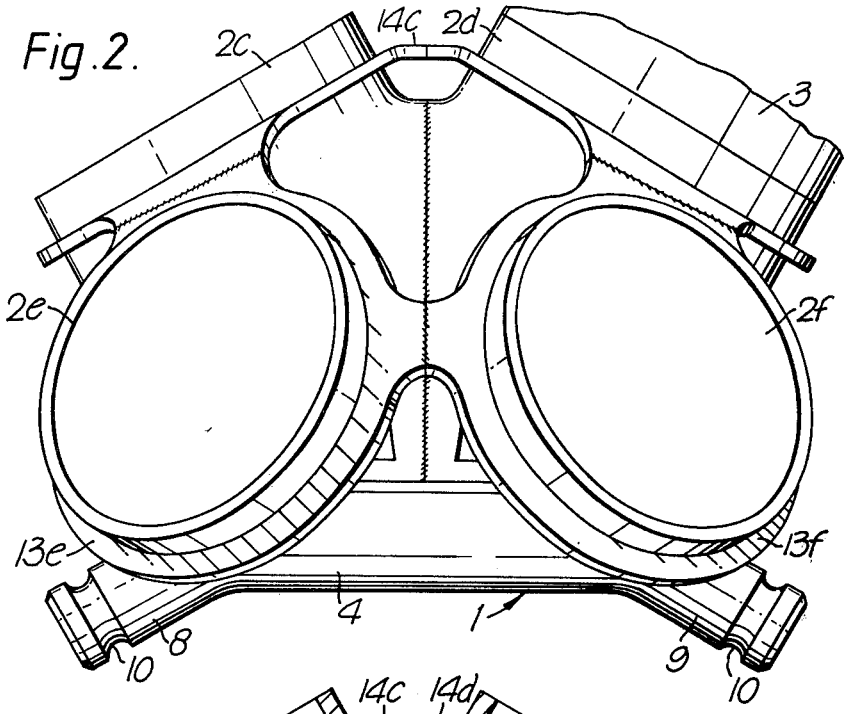
FIG. 2 shows the joint in FIG. 1 seen in the direction II—II, with part of a truss member joined by welding.

As is apparent from FIGS. 1–4, the joint comprises a core member 1 and six transition pieces 2*a*–2*f* which are welded both to the core member 1 and to each other. Tubular truss members may be welded to the free ends of the transition pieces 2*a*–2*f*, and FIG. 2 shows part of such a member 3 which is welded to the transition piece 2*d*.

The structure of the core member 1 appears from FIGS. 6–8. The core member has an elongate, approximately cylindrical trunk 4 which is provided with three longitudinal ribs 5, 6, 7. The core member is at each end provided with a stub 8, 9 preferably having the form of a surface of revolution, the axis of each stub extending at an angle with the axis of the core member. The stubs 8, 9 are each provided with a circumferential groove 10. The stubs 8, 9 serve for fixing of the core member and the joint during its construction, for instance in a jig. The stubs may also serve as guide pins, for instance during transportation and/or launching of a supporting structure in which the joint is incorporated.

The form of the transition pieces 2*a*–2*f* may best be seen from FIGS. 3–5*d*. At the free end the transition pieces have an annular cross section which corresponds to the cross-section of the truss member 3 which is to be welded to this end. In the direction away from the free end the cross section of the transition pieces gradually changes to a narrower, elongate form and terminates in two generally orthogonal, elongate surfaces typically shown in FIG. 3 as 11*c*, 12*c* and 11*d*, 12*d*.

As is apparent from FIG. 3, the transition pieces 2*c* and 2*d* form a pair which are welded to each other along their respective elongate surfaces 12*c* and 12*d*. Hereby their respective other elongate surfaces 11*c* and 11*d* will form an extension of each other, and these surfaces are welded to the rib 6 on the core member 1. Likewise the transition pieces 2*a* and 2*b* form a pair which is welded to the rib 7 of the core member, while the transition pieces 2*e* and 2*f* form a pair which is welded to the rib 5 of the core member.

The joint thus formed will in many embodiments not have sufficient bending stiffness. At their free end the transition pieces may therefore be provided with a generally annular reinforcement 13*a*–13*f* which may be shaped so that it touches the corresponding reinforcement on the adjacent transition pieces. When the reinforcements are welded together along the touching surfaces thus formed, a stiffening of the joint is obtained which entails that substantially no bending forces are transmitted to the core member 1 and its ribs 5, 6, 7. The core member is therefore mainly subjected to pure tensile, compressive and shear forces, thus making it relatively simple to give the truss member a suitable form which utilizes the material well.

In order to reduce the welding work and save material, the annular reinforcements may advantageously have a cross sectional width in the plane of the reinforcement which is greater than its thickness transversely of said plane. Furthermore, the reinforcement may advantageously be provided with at least one radial enlargement 14*a*–14*f* having a smooth cross section transition and ending in a generally tangentially directed surface 15*a*–15*f* which is welded to a corresponding surface on the enlargement of the adjacent transition member. The smooth cross section transition of the enlargements 14*a*–14*d* prevents the occurance of high stress concentrations in the reinforcements. With respect to the reinforcements themselves, they may be welded to the transition pieces, they may be cast in one piece with the transition pieces, or they may be placed in the casting form and cast into the material during casting of the transition pieces. The reinforcements are preferably placed at that part of the transition pieces where their cross sectional form starts to change.

Figures 4, 5A, 5B, 5C, 5D:
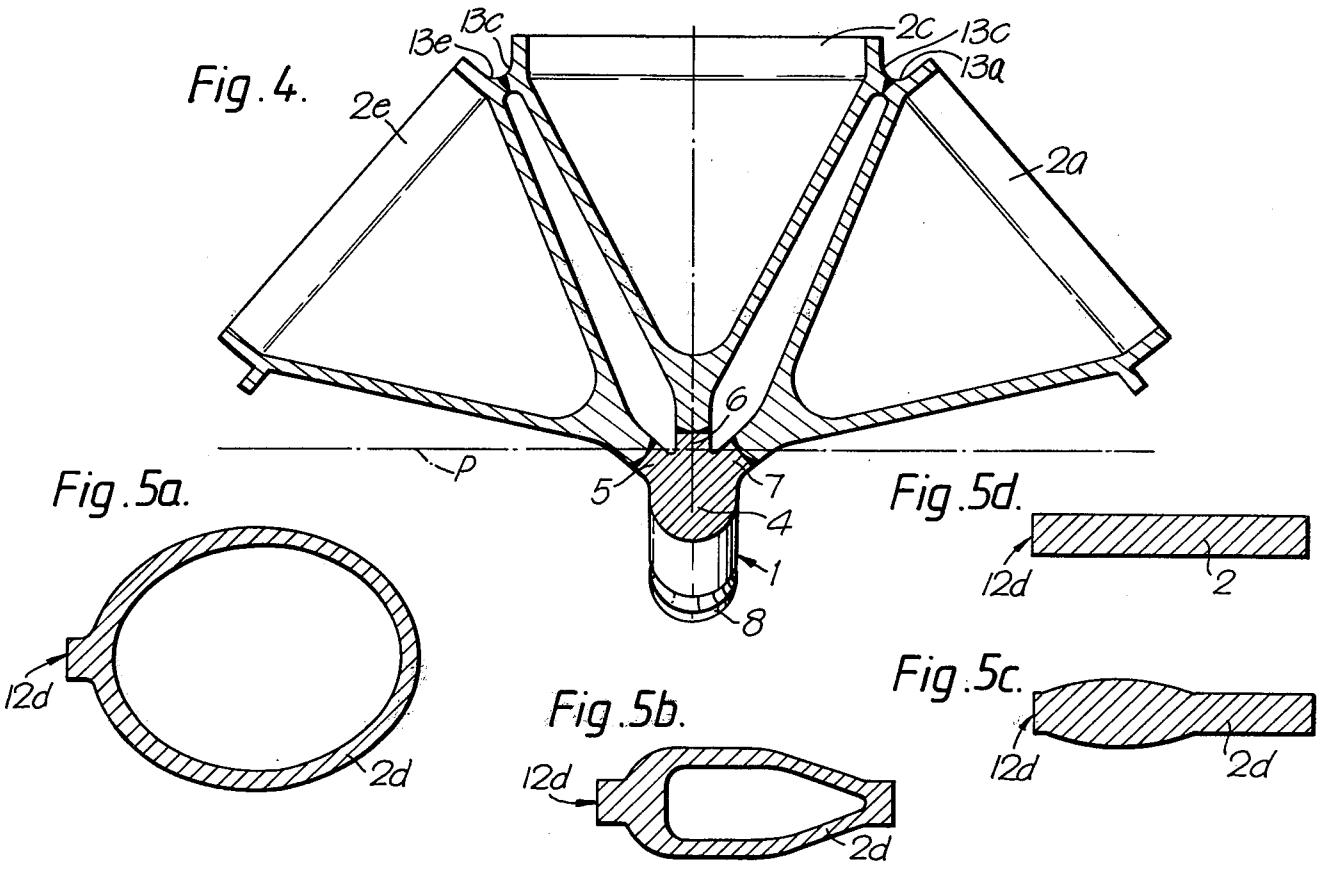
FIG. 4 shows a section along the line IV—IV in FIG. 1.

As will be apparent from FIG. 4, the transition pieces 2*a*–2*f* and the core member 1 lie generally on one side each of a plane P which extends parallel to the longitudinal direction of the core member 1. This facilitates access by automatic welding machines for preforming the welds between the transition pieces and the ribs of the core member. The stubs 8, 9 also lie on the same side of the plane P as the core members so that these may be used for supporting the joint when it is to be welded into a truss structure.

When the joint according to the invention is used in a truss structure of the type described in aforemention patent application, there will be compression in those truss members 3 which are welded to the transition pieces 2*a*, 2*b*, 2*e* and 2*f*, while there will be tension in those truss members which are connected to the transition pieces 2*c* and 2*d*. This entails compressive forces in the ribs 5 and 7 of the core member and tensile forces in the rib 6. The resulting shear forces are absorbed generally by the trunk 4 of the core member. In addition to pure tensile and compressive forces bending moments will occur in the truss members 3. These bending moments will generally tend to bend the transition pieces 2*a* and 2*e* inwardly toward the transition piece 2*c* and the transition pieces 2*e* and 2*f* towards the transition piece 2*d*. These bending moments are thus generally absorbed as compressive forces in the reinforcement connections at the free ends of the transition pieces and shear forces at the ribs 5 and 7 of the core member. The necessary strength and dimension of these sections may therefore be calculated relatively exact.

From FIG. 4 it will also be seen that the truss members will be run as closely to the joint as possible without the truss members touching each other. The joint according to the invention has thus received a very compact form, and despite the fact that the truss members 3 in many cases have very large diameter, the extension of the joint is so small that it may fit in an oven for stress relieving after welding of its different parts. The material consumption is also held to a minimum, this being obvious from the fact that the area of the elongate surface 11*a*–11*f* is smaller than the cross section of the transition pieces 2*a*–2*f* at their free end (FIGS. 5*a*–5*d*).

In the embodiment shown in FIGS. 9–11, the joint comprises a core member 101 and six transition pieces 102*a*–102*f* which along surfaces 111*a*–111*f* are welded to longitudinal ribs 105, 106, 107 on the core member.

The transition pieces are arranged in pairs 102*a*–102*b*, 102*c*–102*d* and 102*e*–102*f*. The two transition pieces in each pair are formed in one piece, for instance by casting, and their internal hollow spaces are communicating with each other, as is apparent from FIG. 10. The transition piece pair thus is free of abrupt cross section changes and other transitions which otherwise might give rise to stress concentrations. Furthermore, the through-going hollow space makes it easier to cast the part and concurrently obtain good material utilization.

At their free end the transition pieces are provided with external radial enlargements 114*a*–114*f* which each are welded to a corresponding radial enlargement on a transition piece in an adjacent pair. The transition pieces are furthermore provided with internal, annular reinforcements 113*a*–113*f*, and these lie generally in the same plane as the external radial enlargements 114*a*–114*f* in order for the forces which are transmitted through the radial enlargements not to give rise to high stresses in the transition pieces.

Since the transition pieces which are welded to one and the same rib is formed in one piece, one obtains a reduced number of parts to be made and welded together. Thus, fewer working operations are required to complete the joint, and fewer working operations reduces the possibility of production errors, welding flaws and the like. By placing the annular reinforcements internally in the transition pieces one obtains reduced hydrodynamic forces when the joint is submerged in water, especially in the splash zone. Furthermore, the joint will have fewer sections particularly exposed to corrosion.

When the joint according to the invention is to be used in a marine environment, it may advantageously be surrounded by a closed, water tight capsule (not shown) which for instance may be made of relative thin steel plates. The capsule may be filled with a corrosion inhibiting medium as oil or inert gas, and it may also be totally or partly filled with a relatively rigid foamed material which could prevent implosion of the capsule when it is subjected to higher hydrostatic pressures. Sealed tubes may be inserted through the capsule and any foamed material in order to form connections for equipment for inspection of welds, from the outside.

Even though the joint according to the invention is particularly suited for truss structures of the type shown in the aforementioned application, it will be clear to the skilled person that the joint may advantageously be used also for other types of truss structures.

We claim:

1. A joint for a truss having truss members constituted by pipe-like hollow bodies, comprising a core member, a plurality of transition pieces attached at one of the ends thereof to said core member, the other and free ends of said pieces being adapted for securement with said hollow bodies, the cross-sections of said pieces changing between said one and said free ends thereof, the improvement wherein said core member has an elongate, substantially cylindrical trunk including a plurality of longitudinal ribs, said cross-sections of said pieces being gradually transitional between annular formations at said free ends and narrow elongate formations at said one ends thereof, said elongate formations defining elongate surfaces along which said pieces are attached to said core member, pairs of said pieces being attached to said ribs, respectively.

2. The joint according to claim 1, wherein said pairs of said pieces respectively form single transition units.

3. The joint according to claim 2, wherein said single units comprise one-piece cast units.

4. The joint according to claim 2, wherein said pieces include other surfaces extending perpendicular to said elongate surfaces, said other surfaces of said pairs of pieces being attached together to form said units.

5. The joint according to claim 1, wherein annular reinforcements are provided adjacent said free ends of said pieces, and radial enlargements extending outwardly of adjacent ones of said pieces and being secured together.

6. The joint according to claim 5, wherein said reinforcements are disposed externally of said pieces, and said radial enlargements extend outwardly of said reinforcements.

7. The joint according to claim 5, wherein said reinforcements are disposed internally of said pieces.

8. The joint according to claim 1, wherein a stub is provided at opposite ends of said core member and has a surface of revolution lying at an angle to the central axis of said member.

9. The joint according to claim 1, wherein said pieces and said member lie on one side of a plane disposed parallel to the central axis of said member.

10. The joint according to claim 8 wherein said pieces and said member including each said stub lie on one side of a plane disposed parallel to the central axis of said member.

11. The joint according to claim 1, wherein the said elongate surfaces are respectively less than the cross-sectional areas of said free ends of said pieces.

* * * * *